US011763785B2

(12) United States Patent
Shigenaga

(10) Patent No.: US 11,763,785 B2
(45) Date of Patent: Sep. 19, 2023

(54) PEDAL APPARATUS FOR PERCUSSION INSTRUMENT

(71) Applicant: YAMAHA CORPORATION, Hamamatsu (JP)

(72) Inventor: Fumihiro Shigenaga, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 987 days.

(21) Appl. No.: 16/598,407

(22) Filed: Oct. 10, 2019

(65) Prior Publication Data

US 2020/0043450 A1 Feb. 6, 2020

Related U.S. Application Data

(63) Continuation-in-part of application No. 15/291,695, filed on Oct. 12, 2016, now abandoned.

(30) Foreign Application Priority Data

Oct. 20, 2015 (JP) ..... 2015-206379

(51) Int. Cl.
*G10D 13/11* (2020.01)

(52) U.S. Cl.
CPC ..... *G10D 13/11* (2020.02)

(58) Field of Classification Search
CPC ..... G10D 13/006; G10D 13/11
USPC ..... 84/422.1, 422.2
See application file for complete search history.

(56) References Cited

U.S. PATENT DOCUMENTS 4,235,146 A * 11/1980 Purdy ..... G10D 13/11 84/422.1
5,540,131 A 7/1996 Shigenaga
6,392,130 B1 5/2002 Carlson
6,894,210 B1 5/2005 Lombardi
6,903,257 B2 6/2005 Yun
(Continued)

FOREIGN PATENT DOCUMENTS

CN 203812553 U 9/2014
CN 104751832 A 7/2015
JP H08123407 A 5/1996
JP 2003255927 A 9/2003
JP 2006343459 A 12/2006

OTHER PUBLICATIONS

"Falcon Single Bass Drum Pedal PF1000—Self-Adjusting Hoop Clamp—Interchangeable Beater Weights." Mapex Drums US, Inc., 2015. Retrieved from http://mapexdrums.com/us/products/hardware/bass-drum-pedals/single/pf1000/ on Sep. 16, 2016. Cited in specification.
(Continued)

*Primary Examiner* — Christopher Uhlir
(74) *Attorney, Agent, or Firm* — ROSSI, KIMMS & McDOWELL LLP

(57) ABSTRACT

A percussion instrument pedal apparatus includes a footboard and a transmission mechanism connectable to the footboard. A beater, which is mountable to a pivot shaft, strikes a bass drum in response to pivoting of the pivot shaft. The transmission mechanism includes two adjusting mechanisms for adjusting the motion characteristics of the footboard and for adjusting the footboard angle. The transmission mechanism can be interchanged with different types, such as a chain-drive transmission mechanism and a direct-drive transmission mechanism.

14 Claims, 21 Drawing Sheets

(56) References Cited

U.S. PATENT DOCUMENTS

| | | | | |
|---|---|---|---|---|
| 7,449,626 | B2 * | 11/2008 | Chen | G10D 13/11 84/422.1 |
| 7,579,539 | B2 | 8/2009 | Chen | |
| 7,579,540 | B2 | 8/2009 | Takegawa | |
| 7,601,902 | B1 * | 10/2009 | Lombardi | G10D 13/11 84/422.1 |
| 7,633,000 | B2 | 12/2009 | Dorfman et al. | |
| 7,696,422 | B1 | 4/2010 | Chang | |
| 7,709,716 | B1 * | 5/2010 | Chen | G10D 13/065 84/422.1 |
| 7,858,861 | B1 * | 12/2010 | Chen | G10D 13/11 84/422.1 |
| 8,063,293 | B1 | 11/2011 | Kjellgren | |
| 9,251,770 | B1 | 2/2016 | Tsuchida | |
| 2003/0159563 | A1 | 8/2003 | Shigenaga | |
| 2006/0278060 | A1 | 12/2006 | Shigenaga | |
| 2015/0187343 | A1 | 7/2015 | Mori | |
| 2016/0314769 | A1 | 10/2016 | Liao | |

OTHER PUBLICATIONS

Notification of Reasons for Refusal issued in Japanese Appln. No 2015-206379 dated Feb. 26, 2019. English machine translation provided.

Office Action issued in U.S. Appl. No. 15/291,695 dated Dec. 8, 2017.

Office Action issued in U.S. Appl. No. 15/291,695 dated Jun. 12, 2018.

Office Action issued in U.S. Appl. No. 15/291,695 dated Dec. 14, 2018.

Office Action issued in U.S. Appl. No. 15/291,695 dated Apr. 11, 2019.

Office Action issued in Chinese Application No. 201610912548.2 dated Mar. 19, 2020. English translation provided.

Office Action issued in Chinese Appln. No. 201610912548.2 dated Dec. 3, 2020. English translation provided.

* cited by examiner

PEDAL APPARATUS FOR PERCUSSION INSTRUMENT

BACKGROUND

The present invention relates generally to pedal apparatus for use in performance of a percussion instrument, such as a bass drum of a drum set, and more particularly to an improvement in a structure for mounting a transmission mechanism to a footboard.

Pedal apparatus for percussion instruments (hereinafter also referred to simply as "percussion instrument pedal apparatus" or "pedal apparatus") are used to perform a percussion instrument, such as a bass drum of a drum set. The pedal apparatus are constructed to strike a drum head of the bass drum by transmitting pivoting force, responsive to a depressing operation on a footboard, to a pivot shaft via a transmission mechanism so that a beater mounted on the pivot shaft pivots in response to pivoting of the pivot shaft.

As an example of the transmission mechanism in the pedal apparatus, there has been known a "chain-drive" type transmission mechanism that comprises a chain member. In the pedal apparatus employing the chain-drive type transmission mechanism, the chain member is fixed at one end to the underside or reverse side (or bottom surface) of the footboard by screws or the like and connected at the other end to the pivot shaft (see, for example, FIG. 3 of Japanese Patent Application Laid-open Publication No. 2006-343459).

As another example of the transmission mechanism, there has been known a "direct-drive" type transmission mechanism that comprises a transmission rod formed of metal, such as aluminum. In the pedal apparatus employing the "direct-drive" type transmission mechanism, a link mechanism is pivotably connected at one end to the distal end of the footboard and connected at the other end to the pivot shaft (see, for example, FIG. 1 of Japanese Patent Application Laid-open Publication No. 2003-255927).

Various other types of transmission mechanisms than the aforementioned have also been known, such as a belt-drive type transmission mechanism using a belt formed of a rubber material, nylon material, leather material or the like. As well known, an operating feel of the pedal apparatus, i.e., characteristics of striking motion, such as a moved amount of a beater responsive to a user's depressing operation, differs depending on the type of the transmission mechanism employed. A pedal apparatus with what type of transmission mechanism should be used depends mainly on a preference of the user.

In the conventionally-known pedal apparatus, the transmission mechanism and the footboard are interconnected directly, whatever the type of the transmission mechanism is. Therefore, depending on the type of the transmission mechanism, engaging members, such as screws, used to directly interconnect the transmission mechanism and the footboard may undesirably project from (or beyond) the underside or reverse side of the footboard toward an under plate. Thus, with the conventionally-known pedal apparatus, there would arise the problems that an adjustable range of the depressed amount of the footboard (i.e., pedal stroke) decreases due to the engaging members projecting from the reverse side of the footboard, and that the projecting engaging members collide against the under plate to damage the under plate, produce noise and cause other inconveniences.

Further, generally, in the conventionally-known pedal apparatus, the transmission mechanism cannot be replaced with a different type of transmission mechanism. Thus, when the user wants to use a plurality of different types of transmission mechanisms, it is necessary to prepare a separate pedal apparatus for each of the different types of transmission mechanisms. In this regard, "Falcon Single Bass Drum Pedal PF1000-Self-Adjusting Hoop Clamp—Interchangeable Beater Weights" by MAPEX DRUMS US, INC., 2015, which is available from the Internet at http://mapexdrums.com/us/products/hardware/bass-drum-pedals/single/pf1000/, discloses a pedal apparatus where different types of transmission mechanisms can be used interchangeably. However, in this case too, the transmission mechanism and the footboard are interconnected in the conventionally-known manner as noted above. Namely, the chain is connected at one end directly to the reverse side of the footboard by means of a screw or the like in the case of the chain-drive type transmission mechanism, and the link mechanism is connected at one end directly to the distal end of the footboard in the case of the direct-drive type transmission mechanism.

SUMMARY OF THE INVENTION

In view of the foregoing prior art problems, the present inventor devised an improved pedal apparatus for a percussion instrument in which the transmission mechanism and the footboard can be connected without use of an engaging member projecting from the reverse side of the footboard, as well as improving the pedal feel by providing first and second adjusting mechanisms.

To accomplish this, the improved pedal apparatus for a percussion instrument includes a striking mechanism mounted on a pivot shaft and constructed to strike a striking surface of the percussion instrument in response to pivoting of the pivot shaft, a footboard adapted for a depressing operation, a connection member pivotably mounted to the distal end of the footboard, and a transmission mechanism having one end connected (coupled) to the connection member and another end connected (coupled) to the pivot shaft, the transmission mechanism transmitting, to the pivot shaft, pivoting motion, responsive to depression of the footboard, received via the connection member.

The connection member is pivotably mounted to the distal end of the footboard, and the transmission mechanism is connected at the lower end to the connection member and connected at the upper end to the pivot shaft of the striking mechanism. Pivoting motion or force responsive to a depression operation on the footboard is transmitted via the connection member to the transmission mechanism and then from the transmission mechanism to the pivot shaft. Then, in response to pivoting of the pivot shaft, the striking mechanism strikes the striking surface of the percussion instrument, such as a bass drum. Namely, the transmission mechanism is connected to the footboard via the connection member rather than being connected directly to the footboard. Therefore, whatever the type of the transmission mechanism employed in, or applied to, the pedal apparatus is, the transmission mechanism can be attached and detached to and from the connection member without the connection member being detached from the footboard. Thus, the mounting of the connection member to the footboard can be made fixed or semi-fixed, so that the present invention can eliminate a need for such a mounting structure where an engaging member, such as a screw, would undesirably project from the reverse side (underside or bottom surface) of the footboard. As a consequence, the transmission mechanism and the footboard can be interconnected without use of an engaging member projecting from the reverse side of the footboard. As an example, the connection member is pivotably mounted to the distal end of the footboard via a pivot (mounting shaft) extending in a generally horizontal direction. Because the pivot (mounting shaft) extends in a generally horizontal direction, it is possible to minimize a portion projecting vertically downward from the reverse side of the footboard.

The transmission mechanism can comprise a chain, a link mechanism or a belt. The connection member can be configured to interchangeably connect thereto different types of transmission mechanisms. Thus, a user can interchangeably use different types of transmission mechanisms on a single pedal apparatus, i.e., by possessing only one pedal apparatus. The connection member can include a position adjusting mechanism for adjusting a connected position between the connection member and the one end of the transmission mechanism. With such a simple position adjusting mechanism constructed to merely adjust the connected position between the connection member and the transmission mechanism, it is possible to adjust an angle of the footboard without changing an angle of the striking mechanism. The other end of the transmission mechanism includes another position adjusting mechanism for adjusting a connected position between the other end and the pivot shaft. By thus adjusting the connected position between the other end and the pivot shaft, it is possible to adjust a relative mounted position of the striking mechanism to the transmission mechanism.

In the percussion instrument pedal apparatus according to the present invention, as the transmission mechanism is connected to the footboard via the connection member, it is possible to remove any engaging member, such as a screw, that projects from the reverse side of the footboard, whatever the type of the transmission mechanism is mounted to the pedal apparatus. Thus, whatever the type of the transmission mechanism is mounted to the pedal apparatus, the present invention can provide a longer pedal stroke than the conventionally-known pedal apparatus where the transmission mechanism is connected directly to the footboard. Further, the present pedal apparatus can effectively prevent inconveniences, such as damage and noise, from occurring due to collision, against the under plate, of an engaging member, such as a screw, projecting from the reverse side of the footboard.

One aspect of the pedal apparatus includes the striking mechanism, which includes a rocker member mounted on the pivot shaft and configured to mount the beater, the footboard adapted for a depressing operation, the connection member, and the transmission mechanism. The transmission mechanism, in one embodiment, includes a transmission member, which can be a chain, a first position adjusting mechanism, and a second position adjusting mechanism.

The first position adjusting mechanism, which is detachably and adjustably connected to the rocker member and pivotally attached to an upper end of the transmission member, adjusts footboard depression characteristics. The first position adjusting mechanism includes an upper adjusting member that is pivotally attached to the upper end of the transmission member and movable relative to the rocker member to substantially linearly move an effective leveraging point, between the transmission member and the upper adjusting member at a resting position of the footboard, away from or toward the rocker member to adjust a pivoting-motion transmission path and adjust the footboard depression characteristics. The upper adjusting member is lockable to any one of a plurality of discrete positions relative to the rocker member The second position adjusting mechanism is detachably and adjustably connected to the connection member and pivotally attached to a lower end of the transmission member and that adjusts an angle of the footboard at a resting position of the footboard. Changing the upper adjusting member to different positions among the plurality of discrete positions changes the angle of the footboard at the footboard resting position. The second position adjusting mechanism includes a lower adjusting member in which a position thereof is adjustable relative to the connecting member to compensate for the change in the angle of the footboard at the footboard resting position caused by the upper adjusting member changing to the different positions.

The transmission mechanism is replaceable with another transmission mechanism that includes a different type of the transmission member, such as a linkage.

Another aspect of the present invention is a pedal apparatus kit that includes the pedal apparatus and two type of transmission mechanisms that are mountable to the same pedal apparatus and that provide different footboard depression characteristics.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the following accompanying drawings.

DETAILED DESCRIPTION

Figure 1:
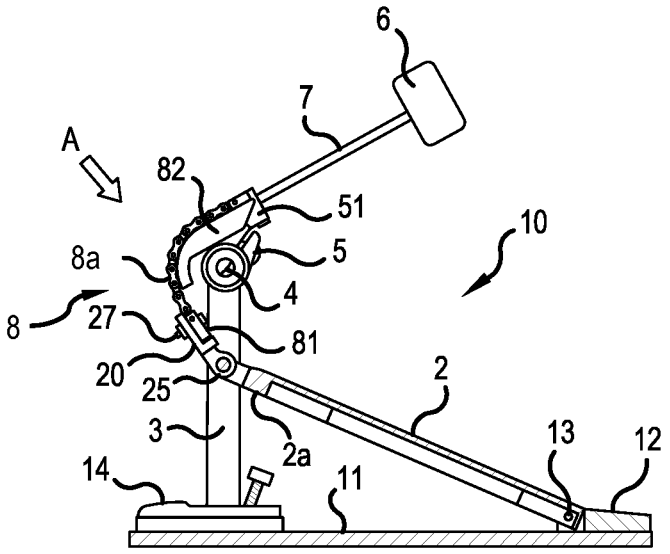
FIG. 1 is a side view, partly in section, showing an overall construction of a pedal apparatus for a percussion instrument installed with a first embodiment of a transmission mechanism, which is a "chain-drive" type while a footboard is at a resting position.
Figure 8D:
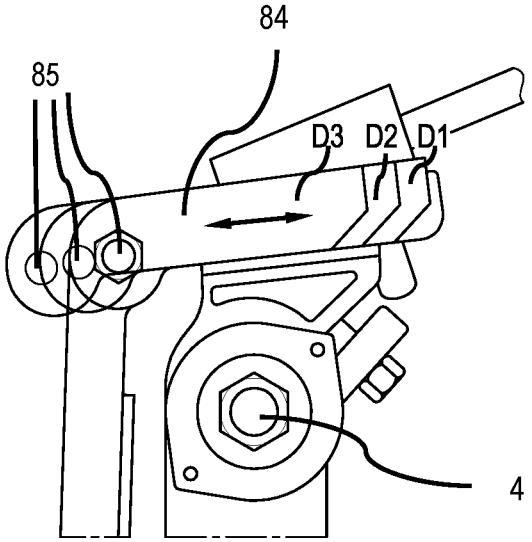
FIG. 8D is a side view of the upper adjusting member of FIGS. 8A-8C, respectively at positions D3-D1 superimposed, at the footboard resting position.
Figure 8:
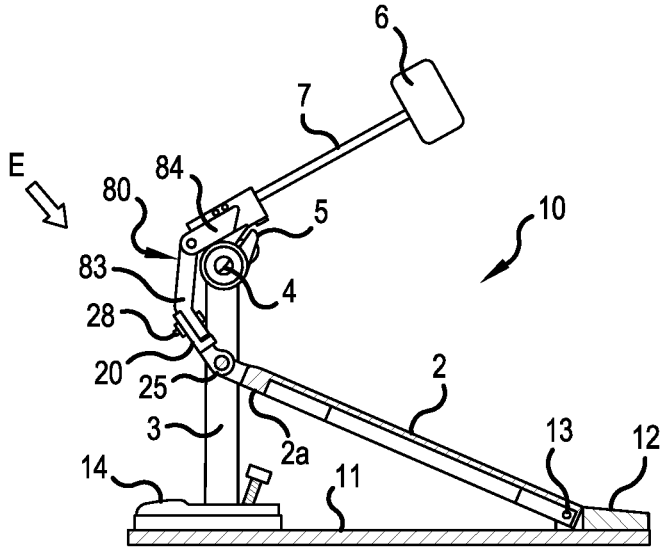
FIG. 8 is a side view of the pedal apparatus of FIG. 1 installed with a direct-drive transmission mechanism, instead of the chain-drive transmission mechanism, at the footboard resting position.

FIG. 1 is a side view, partly in section, showing an overall construction of a pedal apparatus 10 for a percussion instrument ("percussion instrument pedal apparatus 10" or "pedal apparatus 10") according to the present invention, where the same pedal apparatus 10 can be installed with each of at least with a chain-drive transmission mechanism 8 illustrated in FIG. 1, a direct-drive transmission mechanism 80 illustrated in FIG. 8, or a belt-drive transmission mechanism (not illustrated).

Figure 2:
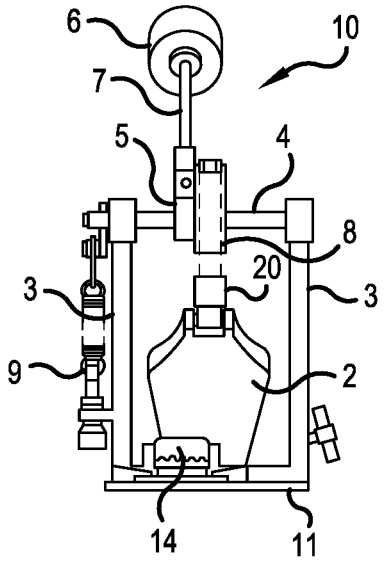
FIG. 2 is a front view of the pedal apparatus shown in FIG. 1.

FIG. 2 is a front view of the pedal apparatus 10 shown in FIG. 1. The pedal apparatus 10 is used, for example, to play or perform a bass drum of a drum set. In the following description, terms "forward," "rearward," "upward," "upper", "lower," and "downward" are used to refer to directions as viewed with the pedal apparatus 10 resting on a horizontal surface. For example, "leftward" in FIG. 1 corresponds to a "forward" direction of the pedal apparatus 10, and "upward" in FIG. 1 corresponds to an "upward" direction of the pedal apparatus 10.

As shown in FIGS. 1 and 2, the pedal apparatus 10 includes a footboard 2 configured to be depressed by a foot of a performer (depressing operation by a human player), a pivot shaft 4 pivotably supported on and between the respective upper ends of a pair of left and right struts 3, a striking mechanism including a beater shaft 7 mounted to a rocker member 5 fixedly mounted on an axially middle portion of the pivot shaft 4, and a beater 6 mounted to the distal end of the beater shaft 7, the chain-drive transmission mechanism 8 that uses a chain 8*a* (transmission member) for transmitting pivoting force to the pivot shaft 4, and a connection member 20 pivotably mounted to the distal end of the footboard 2.

Figure 6A:
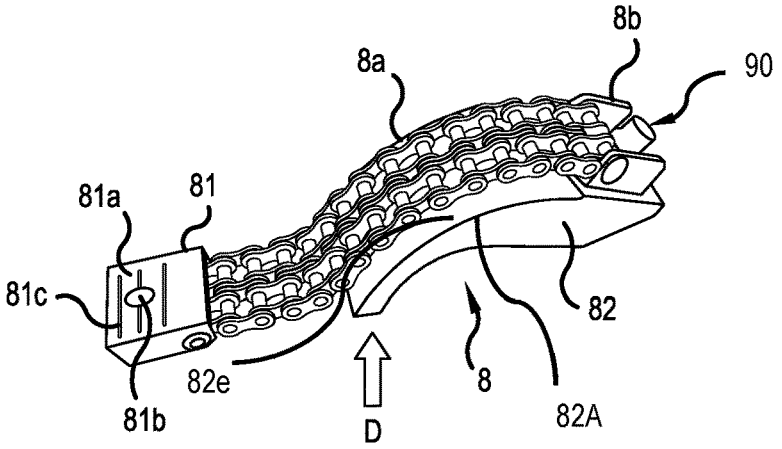
FIG. 6A is a perspective view of a chain member taken along the general direction of arrow A of FIG. 1.

As more clearly illustrated in FIG. 6A, the chain-drive transmission mechanism includes a pivot-shaft connecting member (hereafter upper or first adjusting member) 82 at its first (upper) end connecting to the pivot shaft 4 (via a rocker member 5) and a footboard connecting member (hereafter lower or second adjusting member) 81 at its second (lower) end connecting to the connection member 20, so that pivoting motion responsive to a depressing operation on the footboard 2 is transmitted to the pivot shaft 4 via the chain 8*a*.

The footboard 2 is formed of a flat plate with a size large enough for the human player to place thereon his or her foot, and the footboard 2 is pivotably connected at its rear (proximal) end, via a hinge section 13, to a heel section 12 provided on an under or base plate 11. The connection member 20 is pivotably connected to the front or distal end of the footboard 2. Further, the chain-drive transmission mechanism 8 is detachably connected to the pivot shaft 4, more specifically, to the rocker member 5, via the upper connecting member 82 (see FIGS. 6A and 6B) provided on the upper (first) end of the chain 8*a*. Also, the chain-drive transmission mechanism 8 is detachably connected to the connection member 20 via the lower adjusting member 81 provided on the lower (second) end of the chain 8*a*.

The rocker member 5 is mounted on the pivot shaft 4 to pivot together with the pivot shaft 4, with no relative rotational movement therebetween. The rocker member 5 includes a shaft fixing section 51 that mounts the beater shaft 7. The striking mechanism, including the beater shaft 7 and the beater 6, is thus connected to the pivot shaft 4 by the beater shaft 7 being fixed to the shaft fixing section 51, which in turn is fixed to the rocker member 5, which in turn is fixed to the pivot shaft 4. Further, the pedal apparatus 10 can be mounted to a bass drum (not shown) using, for example, a hoop clamp 14, provided on a front end portion of the under plate 11, so that a striking surface of the bass drum is located in front of the pedal apparatus 10.

Figure 3:
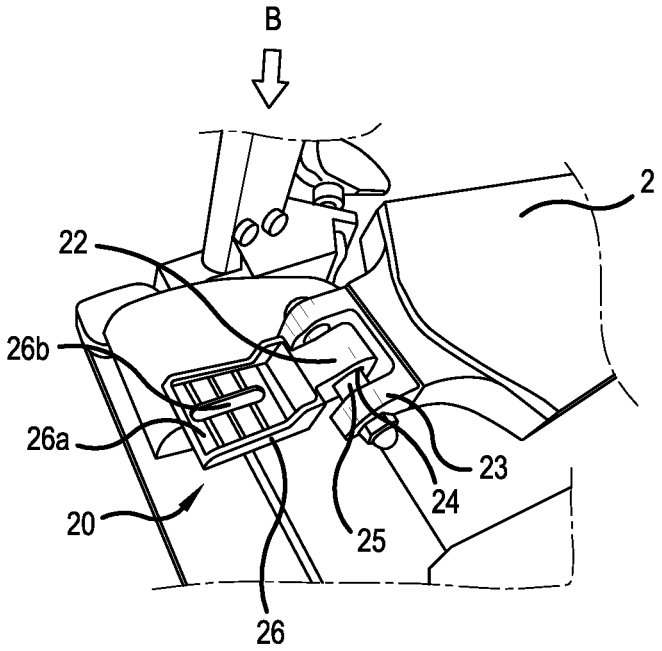
FIG. 3 is an enlarged perspective view of a connection member taken along a general direction of arrow A of FIG. 1.
Figure 4:
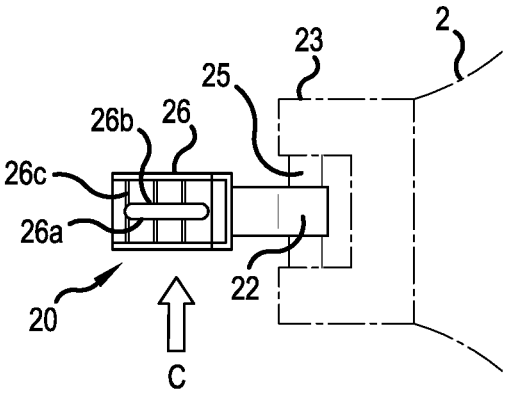
FIG. 4 is a top plan view of the connection member taken along a direction of arrow B of FIG. 3.
Figure 5:
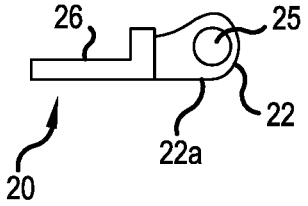
FIG. 5 is a side view of the connection member taken along a direction of arrow C of FIG. 4.

Next, an example construction of the connection member 20 will be described with reference to FIGS. 3-5. FIG. 3 is an enlarged perspective view of the connection member 20 taken along the general direction of arrow A of FIG. 1, with the transmission mechanism detached for clarity. FIG. 4 is a top plan view of the connection member 20 taken along the direction of arrow B of FIG. 3. FIG. 5 is a side view of the connection member 20 taken along the direction of arrow C of FIG. 4. The connection member 20 has a through-hole 24 formed in one (proximal) end portion 22 thereof. The connection member 20 is connected to a front (distal) end portion 23 of the footboard 2 via a mounting shaft 25 passing through the through-hole 24. The front end portion 23 has a generally U shape as viewed from the top. The mounting shaft 25 constitutes a pivot of the connection member 20 and extends along a generally horizontal direction substantially parallel to the pivot shaft 4. The one end portion 22 of the connection member 20 can have a shape and size so that the reverse side (underside) 22*a* (see FIG. 5) of the one end portion 22 projects as little as possible from the reverse side 2*a* (see FIG. 1) of the footboard 2 with the connection member 20 assembled to the pedal apparatus 10. Further, because the only part of the connection member 20 connected to the distal end portion of the footboard 2 is the mounting shaft (pivot) 25 located on the one (proximal) end portion 22 of the connection member 20 and because the mounting shaft (pivot) 25 extends in a generally horizontal direction, the connection member 20 can be easily configured to project as little as possible from the reverse side 2*a* (FIG. 1) of the footboard 2.

The connection member 20 preferably is mounted to the front end portion 23 of the footboard 2 via a bearing (not shown). For example, the bearing (not shown) for pivotably supporting the mounting shaft 25 can be incorporated in the through-hole 24 of the connection member 20. In this case, the mounting shaft 25 is fixed at its opposite ends to opposed legs of the front end portion 23 of the footboard 2, while the connection member 20 is pivotable relative to the mounting shaft 25. As another example, bearings for pivotably supporting the opposite ends of the mounting shaft 25 can be incorporated in the legs of the front end portion 23 of the footboard 2. Namely, in such a case, the mounting shaft 25 would be pivotably mounted to the front end portion 23 of the footboard 2, and the connection member 20 would be pivotable relative to the footboard 2 together with the mounting shaft 25. Mounting the connection member 20 to the front end portion 23 of the footboard 2 via the bearing as noted above permits smoother pivoting movement of the connection member 20 relative to the footboard 2 and can thereby achieve an enhanced operability of the pedal apparatus 10.

Further, the connection member 20 includes a coupling section 26 for coupling or connecting to the lower adjusting member 81 of the chain-drive transmission mechanism 8. The coupling section 26, which extends from the one end portion 22 generally perpendicularly to the mounting shaft 25, has an upper surface 26*a*, left and right side wall portions projecting from the left and right side edges of the upper surface 26*a*, a rear wall portion projecting from the rear end edge of the upper surface 26*a*, and a screw hole 26*b*, which is an elongated slot, formed in a substantial central region of the upper surface 26*a*.

Figure 6B:
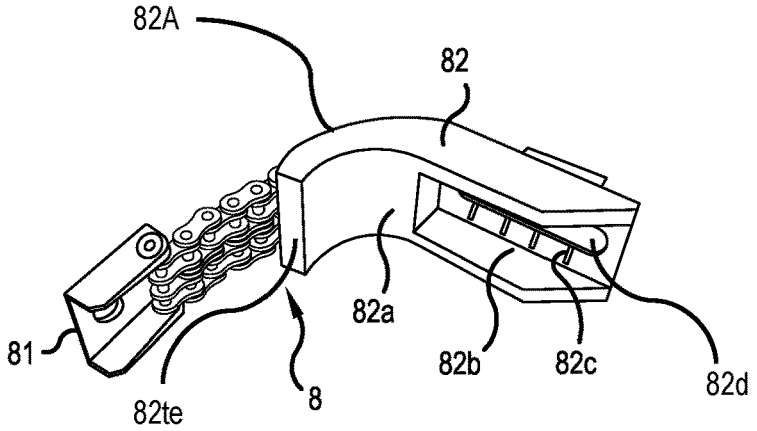
FIG. 6B is a perspective view of the chain member taken in a direction of arrow D of FIG. 6A.

Further, FIGS. 6A and 6B show in detail an example construction of the chain-drive transmission mechanism 8, where FIG. 6A is a perspective view thereof taken along the general direction of arrow A of FIG. 1 and FIG. 6B is a perspective view thereof taken along the direction of arrow D of FIG. 6A. As shown in FIGS. 6A and 6B, the chain-drive transmission mechanism 8 comprises the chain 8*a*, the lower adjusting member 81 pivotally connected to the lower end (second end) of the chain 8*a*, and the upper adjusting member 82 pivotally connected to the upper end (first end) 8*b* of the chain 8*a*.

Figure 6C:
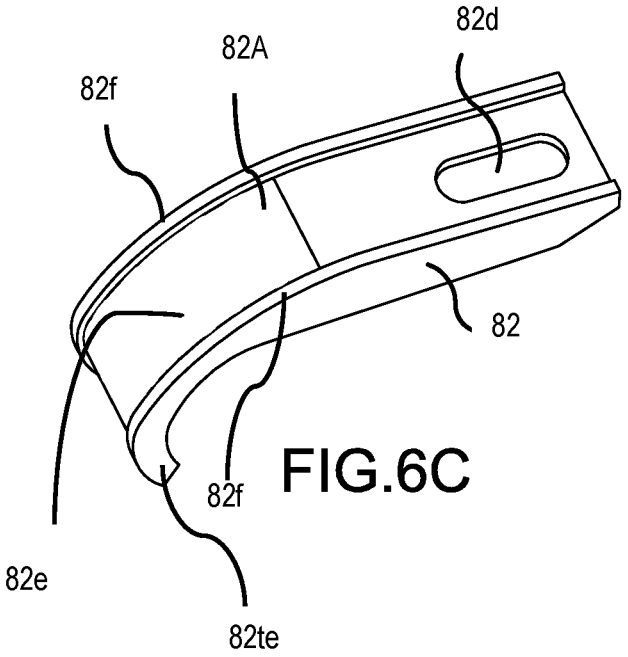
FIG. 6C-6D are perspective views showing another embodiment of an upper adjusting member, similar to the one shown in FIGS. 6A-6B, but with the chain removed to better illustrate the upper side and a lower side thereof.
Figure 6D:
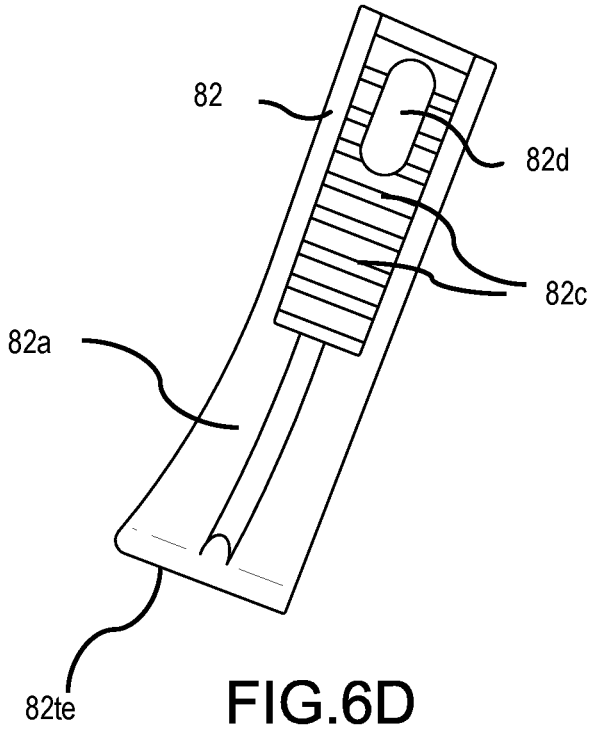

FIG. 6C-6D are perspective views showing another embodiment of an upper adjusting member 82, similar to the one shown in FIGS. 6A-6B, but with the chain removed to better illustrate the upper side and a lower side thereof. In the embodiment of FIGS. 6C-6D, similar to coupling section 26, the upper adjusting member 82 has left and right side wall portions 82*f* projecting from the left and right side edges of the upper surface to retain the chain 8*a* in place, namely to prevent the chain 8*a* from sliding laterally when the tension in the chain 8*a* becomes slack. Otherwise, the upper adjusting member of FIGS. 6C-6D is substantially similar and replaceable with the embodiment illustrated in FIG. 6A-6B.

The lower adjusting member 81 has a complementary shape to fit the coupling section 26 of the connection member 20, i.e., fitting in the interior of the coupling section 26 located between the left and right side wall portions of the coupling section 26 and providing discrete mating positions. The lower adjusting member 81 also has a screw hole 81*b* formed in a substantial central region of the upper surface 81*a* thereof. To connect the chain-drive transmission mechanism 8 to the connection member 20, the upper surface 81*a* of the lower adjusting member 81 is abutted against the upper surface 26*a* (FIGS. 3 and 4) of the coupling section 26, and a screw 27 (see FIG. 1) is screwed in (engaged in) both the screw hole 81*b* and the slot 26*b* (see FIGS. 3 and 4) to thereby fasten the lower adjusting member 81 adjustably to the coupling section 26.

The coupling section 26 of the connection section 20 includes a lower (second) position adjusting mechanism that adjusts the position where the coupling section 26 connects to the lower adjusting member, i.e., connected between the coupling section 26 and the chain 8*a*. The second position adjusting mechanism includes the screw hole 26*b* of the connection member 20 formed as an elongated hole, namely a slot as illustrated in FIGS. 3 and 4, and complementary positioning projections and recesses 26*c*, 81*c* engageable with each other are provided respectively on the mating surface 26*a* of the coupling section 26 of the connection member 20 and the mating surface 81*a* of the lower adjusting member 81 of the chain-drive transmission mechanism 8. The elongated hole 26*b* extends (i.e., slot) in a pivoting-force (pivoting-motion) transmitting direction, or along the length of a pivoting-force (pivoting-motion) transmitting path from the first end to the second end, of the chain 8*a*. The connected position of the chain 8*a* relative to the connection member 20 is adjustable within a range permitted by the length of the elongated hole 26*b*. The connected position of the lower adjusting member 81 relative to the connection member 20 can be determined and adjusted (adjustably determined) stepwise among a plurality of positions defined by the two sets of positioning projections 26*c* and 81*c* formed respectively on the upper surface 26*a* of the coupling section 26 and the upper surface 81*a* of the lower adjusting member 81.

Such a simple adjusting mechanism constructed to adjust the connected position of the lower adjusting member 81 relative to the connection member 20 permits adjustment of a relative mounted position of the footboard 2 to the chain member 8. Thus, it is possible to adjust the angle of the footboard 2 relative to the floor surface without changing a pivotal position of the rocker member 5 (i.e., angle of the beater 6). More specifically, as the connected position of the lower adjusting member 81 relative to the connection member 20 is brought closer to the front end portion 23 of the footboard 2, the angle of the footboard 2 relative to the under plate 11 increases (namely, the front end portion 23 of the footboard 2 rises in position). Conversely, as the connected position of the lower adjusting member 81 is brought farther from the front end portion 23 of the footboard 2, the angle of the footboard 2 relative to the under plate 11 decreases (namely, the front end portion 23 of the footboard 2 lowers in position). Namely, the angle of the footboard 2 relative to the floor surface is made adjustable by the second position adjusting mechanism that adjusts the connected position of the lower adjusting member 81 relative to the connection member 20. This is particularly important, as it can compensate for the change in the footboard angle caused by the first position adjusting mechanism.

Figure 7:
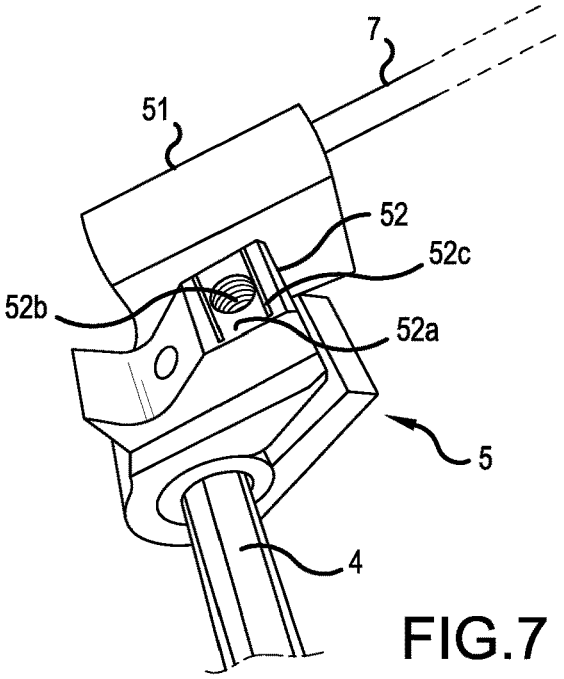
FIG. 7 is an enlarged perspective view of a rocker member taken along the general direction of arrow A of FIG. 1.

The upper end link of the chain 8*a* is pivotally mounted to the upper end bracket 8*b*, which is mounted to the upper adjusting member 82 and secured to the rocker member 5 using a screw/bolt 90 (schematically shown in FIG. 6A) secured to the threaded hole 52*b* (see FIG. 7). Specifically, the screw/bolt extends through a through hole formed in the bracket 8*b* and through the slot formed in the upper adjusting member 82 and threaded into the rocker member 5. The screw/bolt 90 can be secured to the bracket 8*b* to retain it together with the bracket 8*b*. Further, the upper adjusting member 82 has a concave portion 82*b* formed in the reverse side (underneath) 82*a* for engaging with the rocker member 5, and a screw hole 82*d* is formed in the concave portion 82*b*.

Referring to FIGS. 6A-6D, the upper adjusting member 82 includes an arcuate section 82A with an arcuately curved shape, corresponding to a pivoting trajectory of the pivot shaft 4, and is configured so that movement or motion of the chain 8*a* responsive to a depressing operation on the footboard 2 can be transmitted smoothly to the pivot shaft 4 via the upper adjusting member 82. Specifically, the arcuate section 82A includes a curved supporting surface 82*e* that can support substantial portion, namely majority of the chain 8*a* when the footboard is at the resting position shown in FIGS. 1A-1C. At each of the upper adjusting member positions C3-C1 at the footboard resting position shown in FIG. 1A-1C, the curved supporting surface can contact and support at least one-half the length of the chain 8*a* between two connection points thereof or at least three full chain links, between the upper end connection to the upper adjusting member and the lower end connection to the lower adjusting member 81.

Figure 1A:
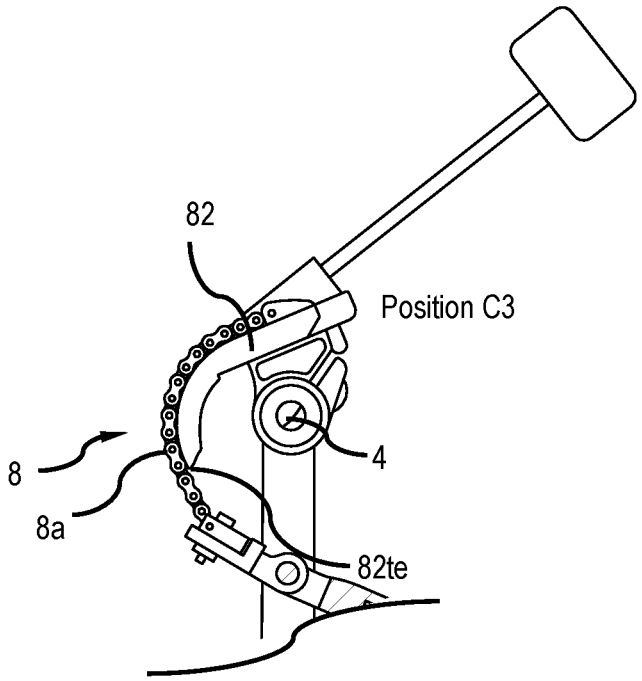
FIGS. 1A-1C are side views showing an upper adjusting member of a first (upper) adjusting mechanism for the chain-drive transmission mechanism, respectively at position C3, C2, and C1, at the footboard resting position.
Figure 1B:
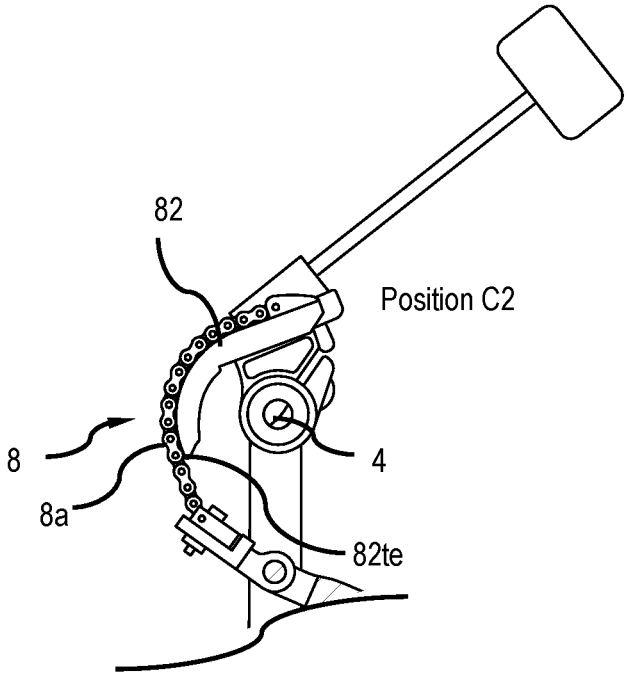
Figure 1C:
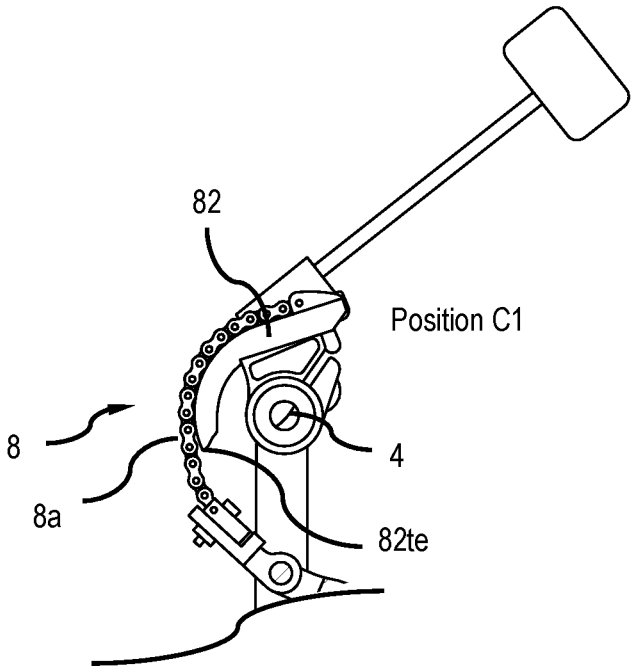
Figure 1D:
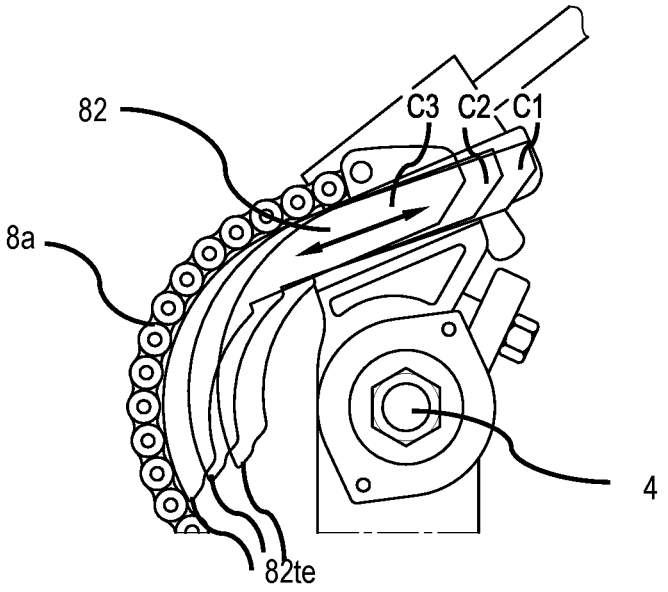
FIG. 1D is a side view of the upper adjusting member of FIGS. 1A-1C, respectively at positions C3-C1 superimposed, at the footboard resting position.
Figure 10:
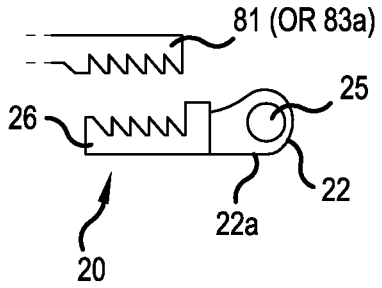
FIG. 10 schematically illustrates how a position adjusting mechanism can provide discrete positions using complementary protrusions and recesses (teeth) between the connection member and the lower adjusting member.

At the footboard resting position and at the positions C1-C3, a terminal distal end 82*te*, which is the farthest point at which the upper adjusting member 82 can support the chain 8*a*, corresponds to an effective leveraging point between the chain 8*a* and the upper adjusting member 82. At the position C3, which is illustrated in FIG. 1A, the terminal end 82*te* is farthest away from the pivot shaft 4. Since the chain is supported until the terminal end 82*te*, when the footpedal is at the resting position, the effective length of the chain becomes reduced at the position C3 in relation to the position C2 and C1. At the position C2, which is illustrated in FIG. 1B, the terminal end 82*te* is closer to the pivot shaft 4 than at the position C3. At the position C1, which is illustrate in FIG. 10, the terminal end 82*te* is closest to the pivot shaft 4 among the three positions. FIG. 1D is a side view of the upper adjusting member 82 superimposed at positions C1-C3, while the footboard 2 is at its resting position, illustrating the relative positions of the terminal end 82*te* between the positions C1-C3. Changing the position of the terminal end 82*te*, in the positions C1-C3 of the upper adjusting member 82, changes the pedal feel characteristics due to the change in the distance between the terminal end 82*te* and the pivot shaft 4, changing the force required to push the footpedal 2 at different positions C1-C3 for the same footpedal position. See FIGS. 11-12 and Tables 1-2 below.

FIG. 7 is an enlarged perspective view of the rocker member 5 taken along the general direction of arrow A of FIG. 1, with the transmission mechanism 8, 80 removed to more clearly show the rocker member 5. The rocker member 5 has an engaging portion 52 for engaging with the concave portion 82*b* of the upper adjusting member 82, and the screw hole 52*b* formed in the upper mating surface 52*a* thereof for receiving the screw/bolt 90. To connect the upper adjusting member 8 to the rocker 5, the concave portion 82*b* of the upper adjusting member 82 is brought into engagement with the engaging portion 52 of the rocker member 5, and the screw/bolt 90 inserted through the bracket 8*b*, which pivotally connects the upper end link of the chain 8*a*, is screwed in, or engaged in, both the screw hole 82*d* of the concave portion 82*b* and the screw hole 52*b* of the engaging portion 52 to thereby fasten the upper adjusting member 82 to the engaging portion 52 of the rocker member 5. In this manner, the upper adjusting member 82 has structure matching or complementary to the rocker member 5 that pivots together with the pivot shaft 4.

The chain-drive transmission mechanism 8 includes the first position adjusting mechanism that adjusts the connected position of the chain 8*a* at its upper end relative to the rocker member 5. The first position adjusting mechanism includes the screw hole 82*d* of the concave portion 82*b* of the upper adjusting member 82 that is formed as an elongated hole (slot). The elongated hole of the concave portion 82*b* extends (is elongated) along the length of the pivoting-force (pivoting-motion) transmitting path of the chain 8*a*. The connected position of the upper adjusting member 82 relative to the rocker member 5, in other words, the connected position between the upper adjusting member 82 and the pivot shaft 4, is adjustable within a range permitted by the length of the elongated hole of the concave portion 82*b*. Further, two sets of complementary positioning projections 82*c* and 52*c* are formed respectively on mutually-abutting surfaces of the concave portion 82*b* of the upper adjusting member 82 and the engaging portion 52 of the rocker member 5, so that the connected position of the upper adjusting member 82 relative to the rocker member 5 can be determined and adjusted (adjustably determined) stepwise among a plurality of positions, e.g., C3-C1 (see FIG. 1A-1D) defined by the two sets of complementary positioning projections 82*c* and 52*c*, and lockable to one of the plurality of positions C3-C1 using the fastener 90.

By changing the connected position between the upper adjusting member 82 and the rocker member 5, it is possible to adjust the relative mounted position therebetween as illustrated in FIGS. 1A-1D. Namely, the first position adjusting mechanism for adjusting the connected position of the upper adjusting member 82 relative to the rocker member 5 allows adjusting a relative mounted position between the chain 8*a* and the beater 6. By adjusting the relative mounted position between the chain 8*a* and the beater 6, it is possible to adjust the motion characteristics of the beater 6 responsive to a depressing operation performed on the footboard 2, i.e., depressing feel of the pedal apparatus 10.

The following describe behavior of the pedal apparatus 10 with the chain-drive transmission mechanism shown in FIGS. 1-6D. As the user depresses the footboard 2 with his or her foot, from the positions shown in FIGS. 1A-1C, the footboard 2 pivots about the hinge section 13 in an up-to-down direction to drive the front end of the footboard 2 downward. Thus, the chain 8*a* is driven downward, via the connection member 20 connected to the front end of the footboard 2, pivoting the pivot shaft 4 counterclockwise, to the positions shown in FIGS. 1E-1G. Namely, pivoting force responsive to the depressing operation on the footboard 2 is transmitted via the connection member 20 to the chain 8*a* and thus causes the rocker member 5, essentially fixed to the chain 8*a*, to pivot about the pivot shaft 4, so that the pivoting force is transmitted to the pivot shaft 4. Then, by the shaft fixing section 51, fixed to the pivot shaft 4, pivoting forward (in the counterclockwise direction) in response to the pivoting movement of the pivot shaft 4, the beater 6 mounted to the distal end of the beater shaft 7 strikes the head of the bass drum (not shown) in the position illustrated in FIGS. 1E-1G disposed in front of the pedal apparatus 10. As the user removes the depressing force from the footboard 2, the footboard 2 returns to the initial non-depressed (resting) position shown in FIGS. 1A-1C by the upward returning force of a returning spring 9 (see FIG. 2) connected to one end of the pivot shaft 4.

Because the chain 8*a* is connected to the footboard 2 via the connection member 20, the pedal apparatus 10 constructed in the aforementioned manner can eliminate the need for any component part, such as an engaging member like a screw, that is needed in the conventionally-known pedal apparatus to connect one end portion of the chain directly to the footboard but undesirably projects from the reverse side of the footboard. Thus, as compared to the conventionally-known pedal apparatus where the one end portion of the chain is connected directly to the reverse side of the footboard, the embodiment of the pedal apparatus 10 can provide a longer pedal stroke. Besides, the pedal apparatus 10 can effectively prevent inconveniences, such as damage and noise, from occurring due to collision, against the under plate 11, of a screw etc., projecting from the reverse side of the footboard 2.

FIG. 8 is a side view is similar to FIG. 1, but with the direct-drive transmission mechanism mounted. The same pedal apparatus illustrated in FIG. 1 can mount the direct-drive transmission mechanism 80 instead of the chain-drive transmission mechanism 8. In the direct-drive pedal apparatus 10 shown in FIG. 8, the direct-drive transmission mechanism 80 is connected at its lower end (second end) to the connection mechanism 20 connected to the front end of the footboard 2, and the direct-drive transmission mechanism 80 is connected at its upper end (first end) to the pivot shaft 4 via the upper adjusting member 84 provided on the upper end (first end) and the rocker member 5. Pivoting force responsive to the depressing operation performed on the footboard 2 is transmitted via the connection member 20 to the direct-drive mechanism 80, so that the direct-drive transmission mechanism 80 transmits the pivoting force to the pivot shaft 4.

Figure 9A:
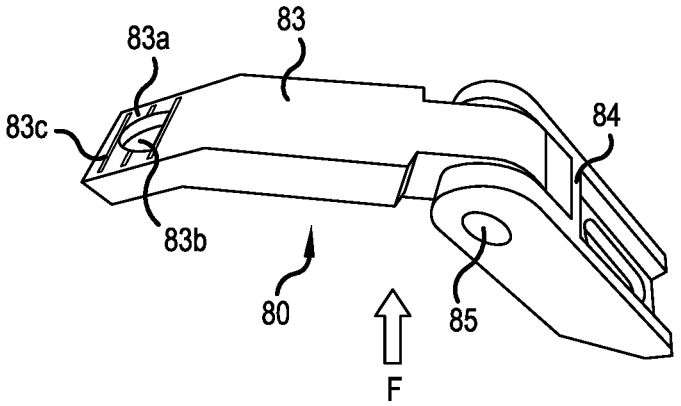
FIG. 9A is a perspective view of the link mechanism taken along a general direction of arrow E of FIG. 8.
Figure 9B:
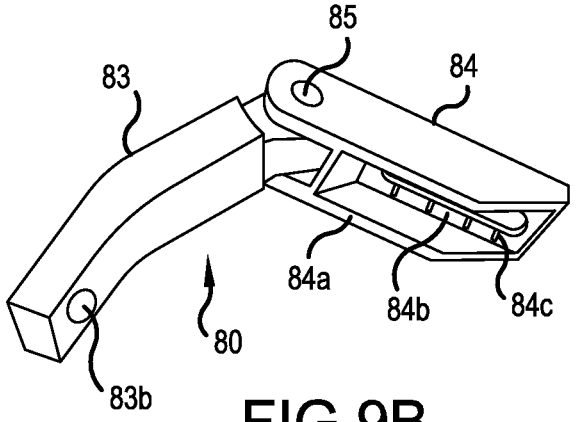
FIG. 9B is a perspective view of the link mechanism taken along a direction of arrow F of FIG. 9A.

FIGS. 9A and 9B are fragmentary enlarged perspective views of the direct-drive mechanism 80, where FIG. 9A shows the direct-drive transmission mechanism 80 taken along the general direction of arrow E of FIG. 8, and FIG. 9B shows the direct-drive transmission mechanism 80 taken along the direction of arrow F of FIG. 9A. The direct-drive transmission mechanism 80 includes a transmission rod 83 (transmission member), which can be made of die-cast of metal, such as aluminum, and the upper adjusting member 84 (corresponding to the upper adjusting member 82 of the chain-drive transmission mechanism 8) for connection to the rocker member 5, and an upper end portion of the transmission rod 83 and a lower end portion of the upper adjusting member 84 are pivotably interconnected using a pivot shaft 85. The connection arrangement can be made similar to the connection between the connection member 20 and the front end portion 23 of the footboard 2.

The transmission rod 83 includes a lower adjusting portion (member) 83*a* formed on its lower end for connecting to the connection member 20. The lower adjusting member 83*a* has a shape fitting (complementary with) the coupling section 26 (see FIG. 3) of the connection member 20, similar to the lower adjusting member 81 of the chain-type transmission mechanism 8, and the lower adjusting member 83*a* has a screw hole 83*b* similar to the screw hole 81*b* of the lower adjusting member 81. To connect the direct-drive transmission mechanism 80 to the connection member 20, the upper surface of the lower adjusting member 83*a* is abutted against the upper surface 26*a* (see FIGS. 3 and 4) of the coupling section 26, and a screw 28 (see FIG. 8) is screwed in, or engaged in, both the screw hole 83*b* and the screw hole 26*b* (see FIGS. 3 and 4) to thereby fasten the transmission rod 83 to the connection member 20.

The second position adjusting mechanism adjust the connected position between the connection member 20 and the transmission rod 83 within a range permitted by the length of the elongated hole 26*b* extending (or elongated) along the length of the pivoting-force (pivoting-motion) transmitting path from the first end to the second end of the link mechanism 80. Further, similar to the arrangement in the chain-drive transmission mechanism, a plurality of engaging or positioning projections 83*c* are also formed on the lower adjusting member 83*a*, so that the connected position between the connection member 20 and the lower adjusting member 83*a* can be determined and adjusted stepwise among a plurality of positions defined by the two sets of engaging projections 26*c* and 83*c* of the coupling section 26 and the lower adjusting member 83*a*. With the conventionally-known direct-drive type pedal apparatus, where a link mechanism is connected directly to the footboard, adjustment of the connected position between the link mechanism and the footboard cannot be achieved with a simple mechanism. In contrast, in the present direct-drive type pedal apparatus 10 provided with the direct-drive transmission mechanism 80, it is also possible to adjust the mounted position of the footboard relative thereto with a simple mechanism of adjusting the connected position thereof.

Further, similar to the arrangement of the upper adjusting member 82, the upper adjusting member 84 is provided at the upper end of the direct-drive transmission mechanism 80 and includes a concave portion 84*b* formed in its underside 84*a* and engageable with the engaging portion 52 (see FIG. 7) of the rocker member 5. To connect the adjusting member 84 to the rocker member 5, the concave portion 84*b* is mounted to the engaging portion 52, and the screw 90 (see FIG. 6) is screwed in, or engaged in, both the screw hole 84*c* of the concave portion 84*b* and the screw hole 52*b* of the engaging portion 52. Namely, in the direct-drive type pedal apparatus 10, the first end (upper adjusting member 84) has structure matching the rocker 5 that is pivotable together with the pivot shaft 4.

The direct-drive transmission mechanism 80 also includes the first position adjusting mechanism for adjusting the connected position of the transmission rod 83 relative to the rocker member 5. Namely, the screw hole 84*d* of the concave portion 84*b* is formed as an elongated hole extending along the length of the pivoting-force transmitting path, and the connected position of the transmission rod 83 relative to the rocker member 5 can be adjusted within a range permitted by the length of the elongated hole 84*c*. Further, as shown in FIGS. 9A and 9B, a plurality of engaging projections 84*c* are also formed on the concave portion 84*b*, so that the connected position of the transmission rod relative to the rocker member 5 can be determined and adjusted stepwise among a plurality of positions (e.g., D3-D1 illustrated in FIGS. 8A-8D) defined by the two sets of engaging projections 84*c* and 52*c*, like the chain-drive transmission mechanism 8.

The connection member 20 employed in the present invention can interchangeably connect thereto different types of transmission mechanisms, more specifically the aforementioned chain-drive transmission mechanism 8 and the direct-drive transmission mechanism 80. Namely, the coupling section 26 of the connection member 20 is configured to match both the lower adjusting member/portion 81 and 83*a* provided at the end portions of the chain 8*a* and the transmission rod 83. Thus, the user can selectively create either the chain-drive pedal apparatus or the direct-drive pedal apparatus by merely changing the transmission mechanism. Attachment and detachment of the transmission mechanisms 8 and 80 to and from the connection member 20 can be effected with utmost ease by attaching and detaching the screw 27, 28 to and from a desired position of the coupling section 26 located forward of the front end of the footboard 2. Thus, the user can easily attach and detach the transmission mechanisms 8 and 80 to and from the connection member 20 without performing cumbersome operation, such as extending a hand under the footboard 2 to attach and detach the screw.

As known in the art, the chain-drive type pedal apparatus and the direct-drive type pedal apparatus differ from each other in operating feel, such as characteristics of striking motion of the beater 6, such as a moved amount of the beater responsive user's depressing operation. Allowing the user to select any one of different types of transmission mechanisms is very convenient to the user in that any one of different types of pedal apparatus, differing from each other in operating feel, can be used easily without involving cumbersome labor, such as preparing in advance different types of pedal apparatus and then replacing one type of pedal apparatus with another as needed.

Figure 1E:
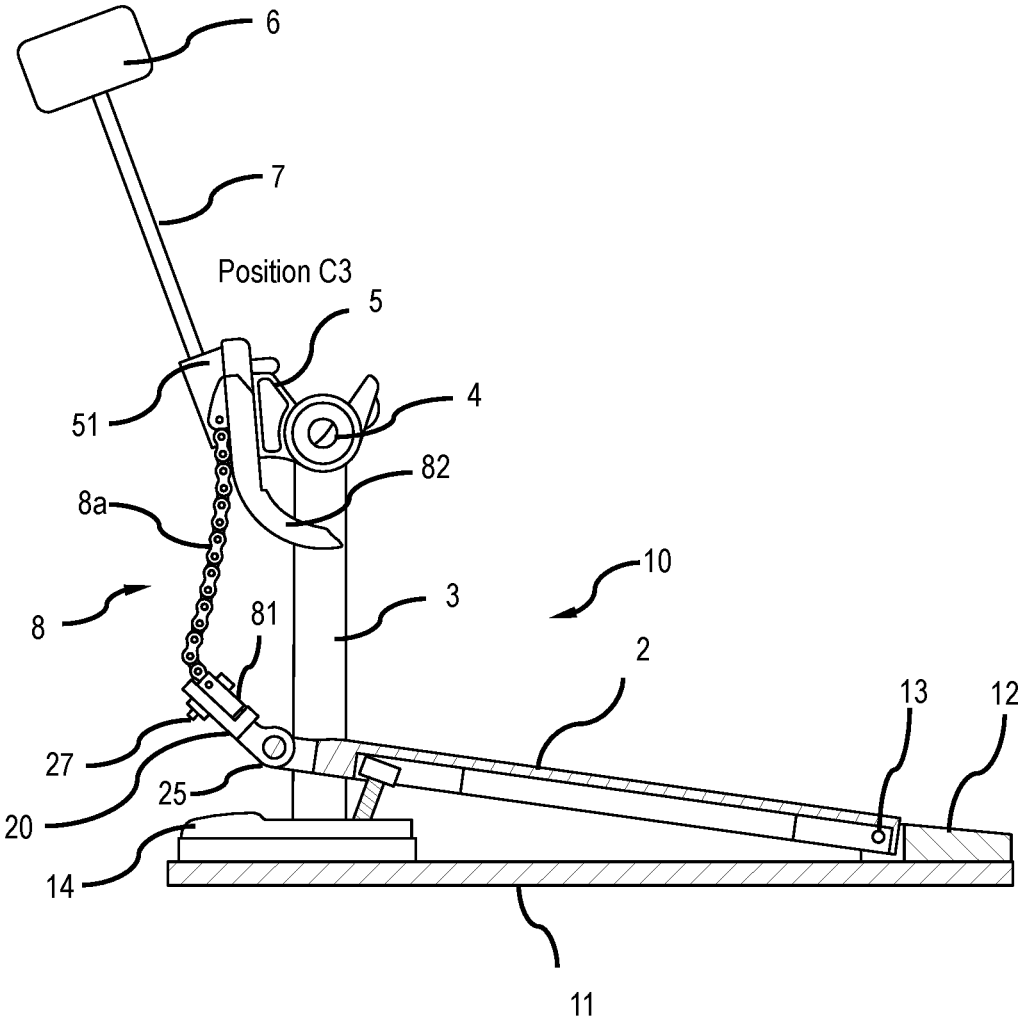
FIGS. 1E-1G are side views showing the upper adjusting member of the chain-drive transmission mechanism, respectively at positions C3-C1, while the footboard is at a fully depressed position.
Figure 1F:
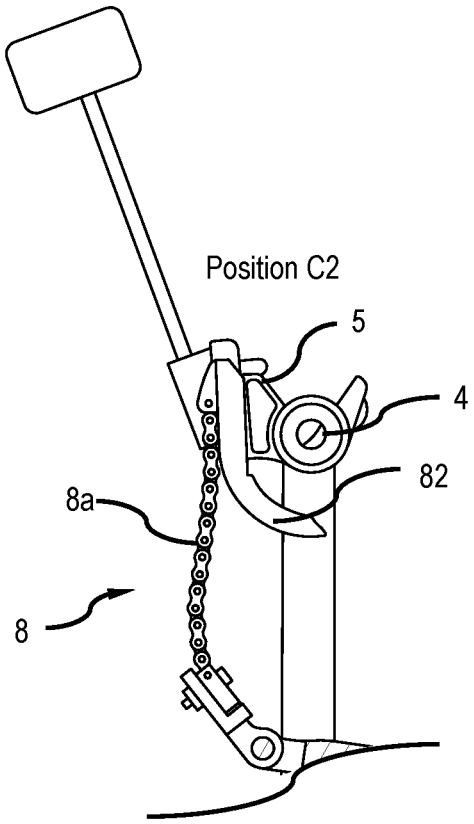
Figure 1G:
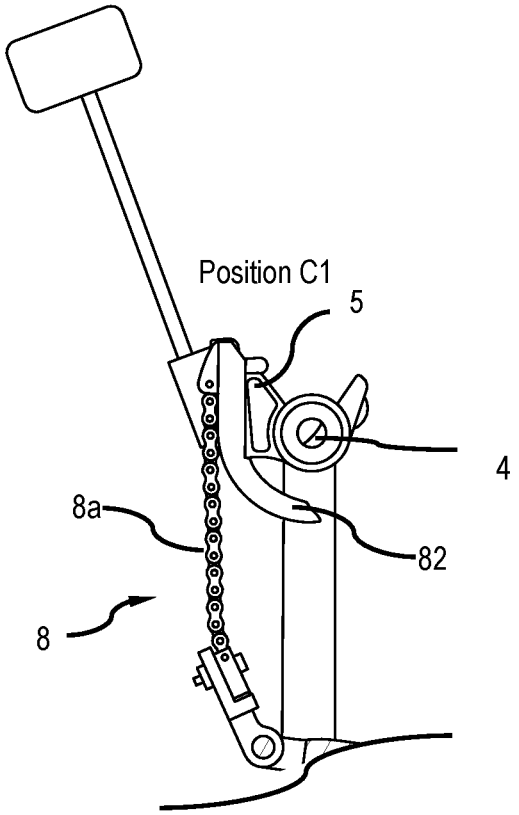

FIGS. 1E-1G are side views of the upper adjusting member 82 of the chain-drive transmission mechanism respectively at positions C3-C1 while the footboard is at a fully depressed position. When the footpedal 2 is fully depressed from the resting position, the rocker member 5 pivots substantially about 70° to the impact position where the beater is disposed to engage the percussion instrument. In this position, the chain 8*a* no longer is supported by the curved supporting surface 82*e* at the positions C1-C3.

Figure 8A:
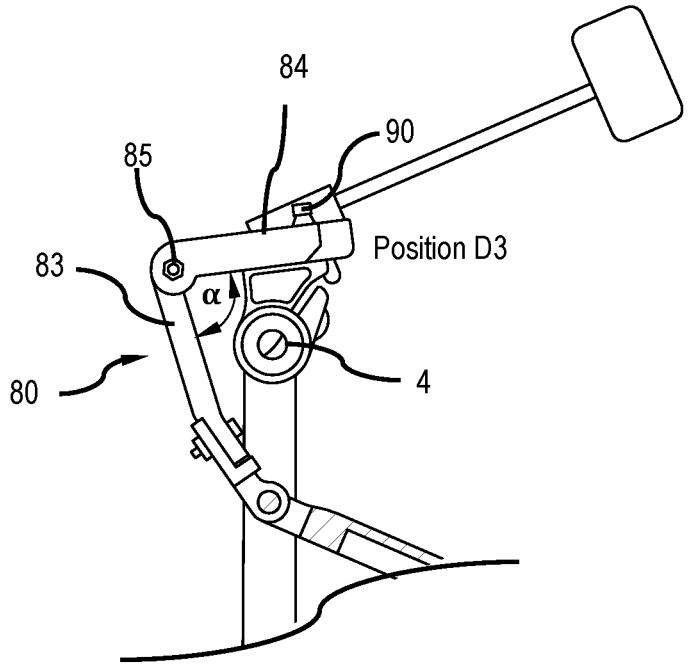
FIGS. 8A-8C are side views of an upper adjusting member of a first (upper) adjusting mechanism of the direct-drive transmission mechanism respectively at position D3, D2, and D1, at the footboard resting position.
Figure 8B:
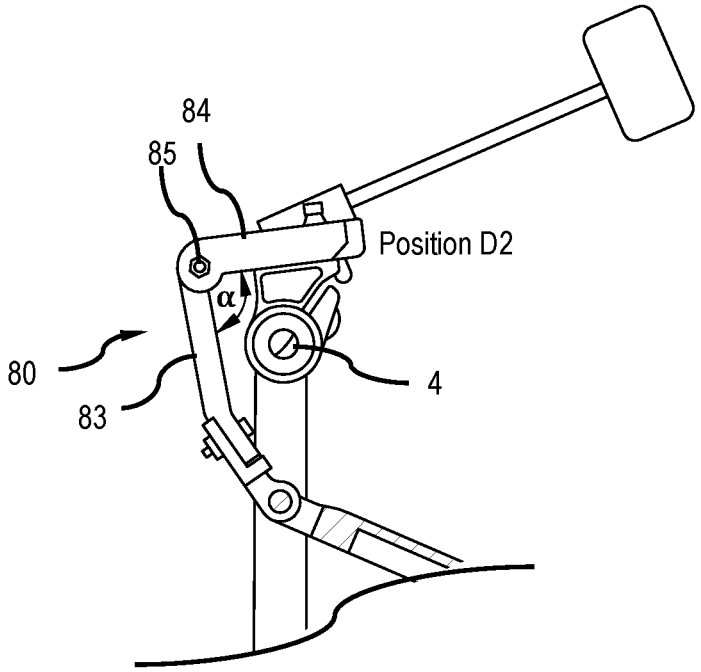
Figure 8C:
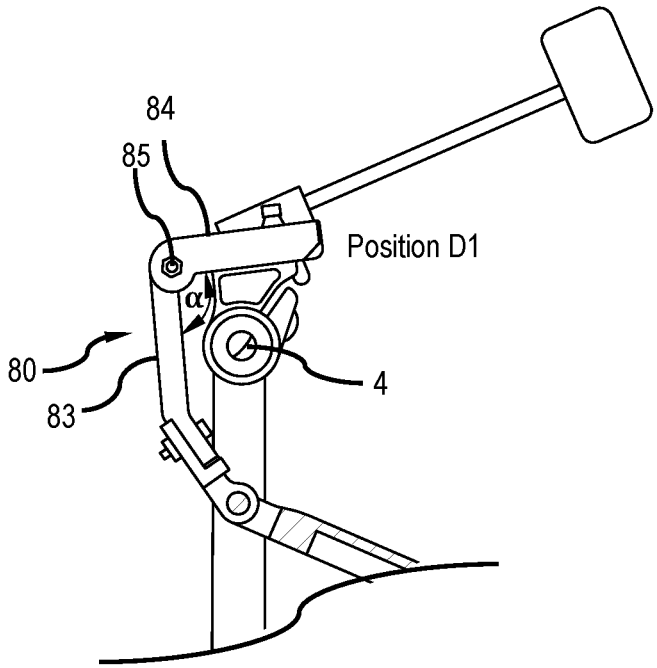
Figure 8E:
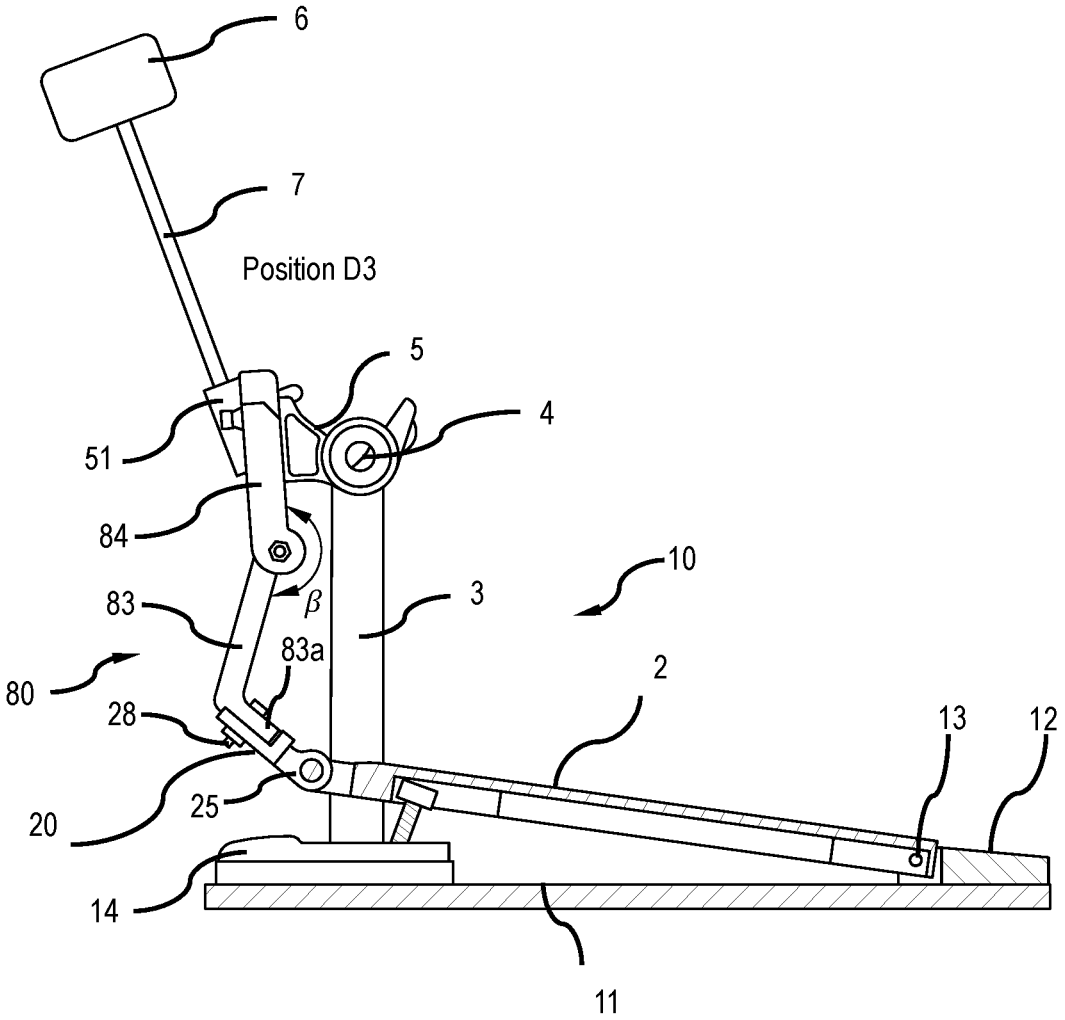
FIG. 8E-8G are side views showing the upper adjusting member of the direct-drive transmission mechanism, respectively at positions D3-D1, while the footboard is at the fully depressed position.
Figure 8F:
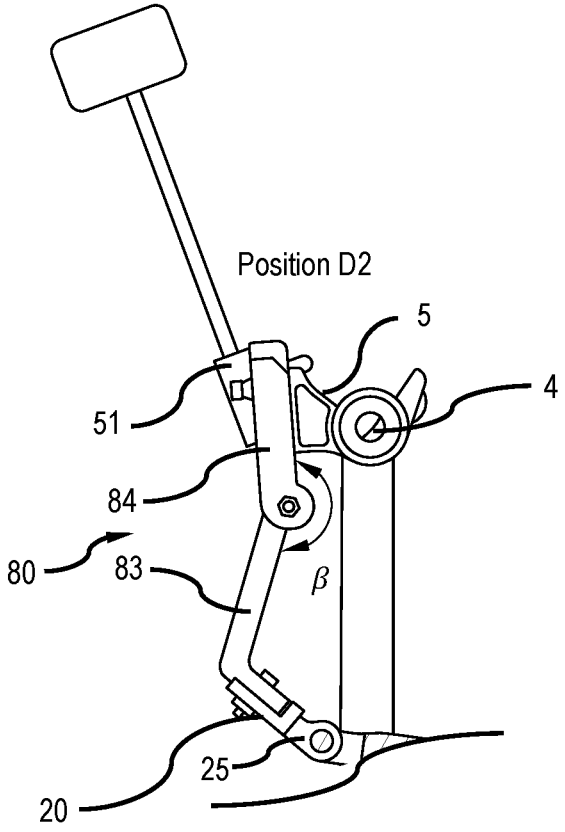
Figure 8G:
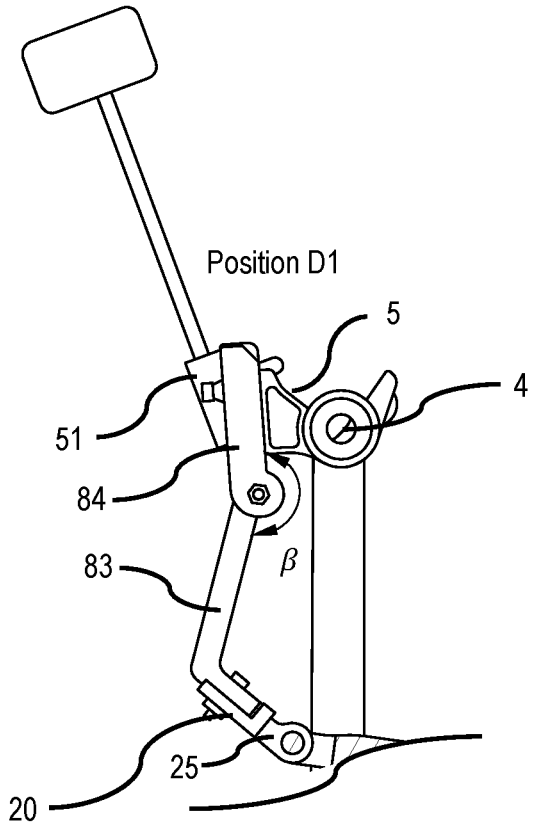

Similarly, FIGS. 8E-8G are side views of the corresponding upper adjusting member 84 of the direct-drive transmission mechanism respectively at positions D3-D2 at the footboard fully depressed position.

FIGS. 8A-8C are side views of the corresponding upper adjusting member 84 of the direct-drive transmission mechanism respectively at position D3, D2, and D1, while the footboard is at the resting position. FIG. 8D, like FIG. 1D, is a side view of the upper adjusting member at positions D1-D3 superimposed at the footboard resting position show the positional differences between the positions D1-D3. At the footpedal at its rest position, the beater is positioned to pivot substantially about 70° to impact with the drum head.

At the footboard resting position and at the positions D1-D3, the pivot shaft 85, which is the connection point of the upper adjusting member 84 and the transmission rod 83, corresponds to the effective leveraging point between the transmission rod 83 and the upper adjusting member 84. Unlike the upper adjusting member 82 of the chain-drive transmission mechanism, the pivot shaft always remain be in contact with the transmission rod 83. That is, as the pivot shaft 4 is pivoted, the effective point of leverage will substantially remain at the pivot shaft 85 instead of changing along the curved surface 82*e* of the chain-drive transmission mechanism. The location of the pivot shaft 85 thus controls the pedal feel characteristics.

At the position D3, which is illustrated in FIG. 8A, the pivot shaft 85 or the connection point between the upper adjusting member 84 and the transmission rod 83 is farthest away from the pivot shaft 4. At the position D2, which is illustrated in FIG. 8B, the pivot shaft 85 is closer to the pivot shaft 4 than at the position D3. At the position D1, which is illustrate in FIG. 8C, the pivot shaft 85 is closest to the pivot shaft 4 among the three positions. FIG. 8D is a side view of the upper adjusting member 84 superimposed at positions D1-D3, while the footboard is at its resting position, illustrating the relative positions of the pivot shaft between the positions D1-D3. Changing the position of the pivot shaft 85 in the positions D1-D3 of the upper adjusting member 84 change the pedal feel characteristics due to the change in the distance between the pivot shaft 85 and the pivot shaft 4, changing the force required to push the footpedal 2 at different positions D1-D3 for the same footpedal position. See FIGS. 11-12 and Tables 1-2 below.

At the footpedal rest position, the upper adjusting member 84 is almost horizontally extending, but not quite horizontal. The upper adjusting member 84 and the transmission rod (linkage) 83 pivotally connecting to the upper adjusting member 84 form an angle α that is not greater than 90° as shown in FIGS. 8A-8C. At the footboard fully depressed position, where the beater has pivoted substantially about 70° (see FIGS. 8E-8G) from the rest position (see FIGS. 8A-8C), the upper adjusting member 84 and the transmission rod 83 are almost straight. Specifically, the upper adjusting member 84 and the transmission rod 83 form an angle β greater than 180° (not less than 180°). Since the transmission rod 83 is pivotally mounted to the upper adjusting member 84, it can pivot more than the pivot angle) (70°) of the pivot shaft 4. Note that during the footpedal depression from the rest position to the fully depressed position, the pivot shaft rotates substantially about 70 degrees.

TABLE 1

| Beater Travel | Absolute FootPedal Force (kgf) to Displace Beater by 10° | | | | | |
|---|---|---|---|---|---|---|
| Angle | C1 | C2 | C3 | D1 | D2 | D3 |
| 0 | 0.000 | 0.000 | 0.000 | 0.000 | 0.000 | 0.000 |
| 10 | 0.429 | 0.374 | 0.331 | 0.561 | 0.486 | 0.429 |
| 20 | 0.882 | 0.774 | 0.687 | 1.034 | 0.906 | 0.804 |
| 30 | 1.376 | 1.221 | 1.093 | 1.496 | 1.326 | 1.187 |
| 40 | 1.914 | 1.727 | 1.568 | 2.003 | 1.800 | 1.629 |
| 50 | 2.481 | 2.287 | 2.115 | 2.598 | 2.379 | 2.187 |
| 60 | 3.053 | 2.883 | 2.727 | 3.343 | 3.136 | 2.950 |
| 70 | 3.590 | 3.481 | 3.378 | 4.338 | 4.211 | 4.095 |

Figure 11:
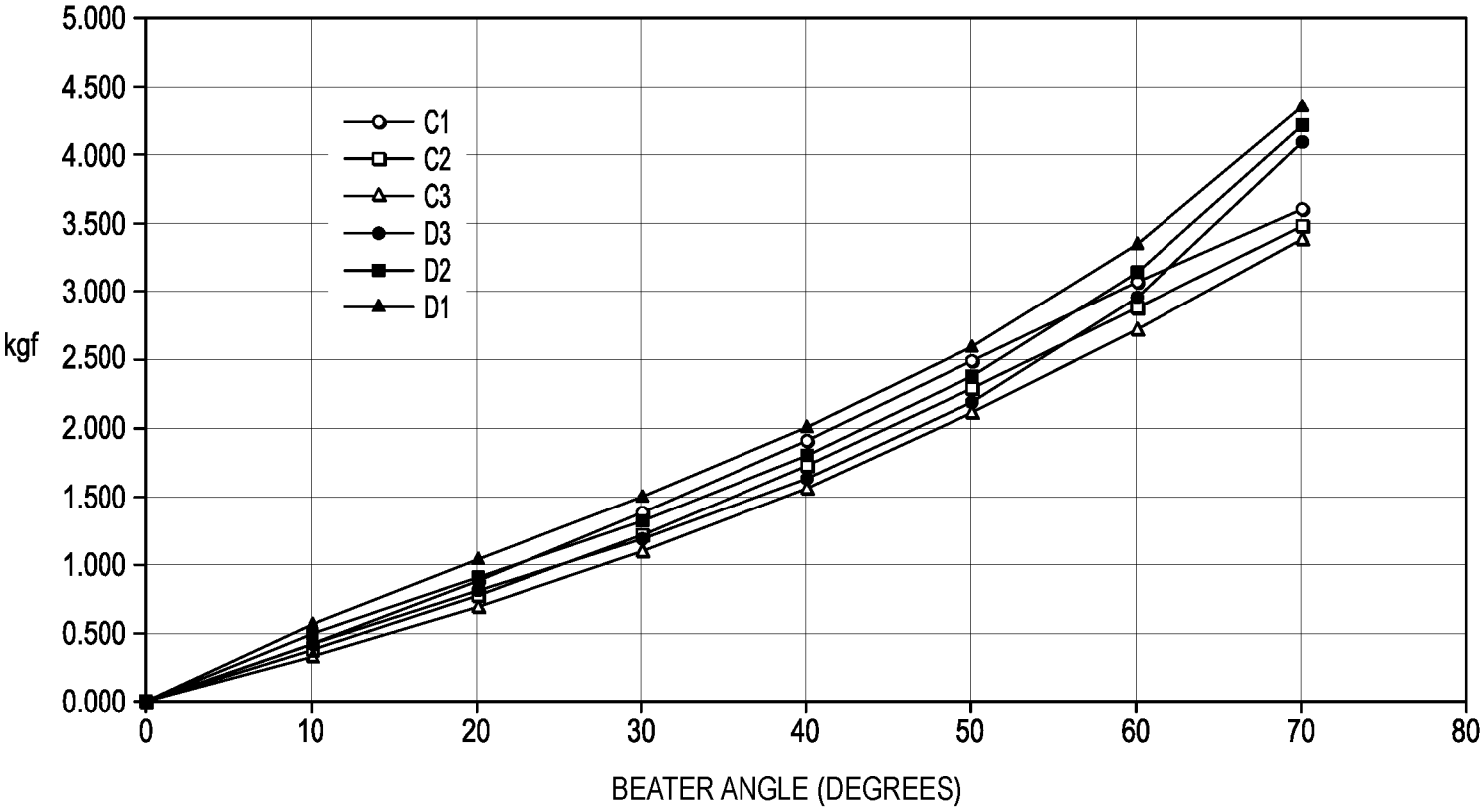
FIG. 11 is a graph obtained from Table 1, showing the absolute footboard pedal force applied to move the beater, from the footboard resting position to the footboard fully depressed position, at respective positions C1-C3 and D1-D3 of the upper adjusting member.

Table 1 and FIG. 11, which is a graph of the data in Table 1, show the absolute footboard pedal force applied to move from the footboard resting position to the footboard fully depressed position at respective positions C1-C3 and D1-D3. The data contained in Table 1 measured the absolute amount of force (in kgf) needed to move the pedal from its rest position to fully depressed (this angle being changeable with the second adjusting mechanism) when the spring 9 has a predetermined spring (tension) rate. Referring to FIGS. 1D and 8D, changing the positions between C1-C3 or D1-D3 alters the footboard angle due to the upper adjusting member 82, 84 changing the leverage amount. Specifically, at the position C1 and D1, the footboard 2, at its rest position, is at the most elevated position, while at the position C3 and D3, the footboard 2, at its rest position, is at the lowest position. Using the second adjusting mechanism, the footboard angle can be elevated or lowered to compensate for the elevation change caused by changing the positions C1-C3 or D1-D3, to allow the footboard angle to be set at a desired angle. By providing first and second adjusting mechanisms, the desired pedal characteristic can be obtained while maintaining the desired footboard angle.

TABLE 2

| Beater | Relative FootPedal Force (kgf) to Displace Beater by 10° | | | | | |
|---|---|---|---|---|---|---|
| Travel Angle | C1 | C2 | C3 | D1 | D2 | D3 |
| 10 | 0.429 | 0.374 | 0.331 | 0.561 | 0.486 | 0.429 |
| 20 | 0.453 | 0.400 | 0.356 | 0.473 | 0.419 | 0.375 |
| 30 | 0.493 | 0.447 | 0.406 | 0.462 | 0.421 | 0.383 |
| 40 | 0.538 | 0.506 | 0.475 | 0.506 | 0.474 | 0.443 |
| 50 | 0.568 | 0.560 | 0.546 | 0.595 | 0.579 | 0.558 |
| 60 | 0.572 | 0.595 | 0.612 | 0.745 | 0.757 | 0.762 |
| 70 | 0.537 | 0.598 | 0.651 | 0.995 | 1.074 | 1.145 |

Figure 12:
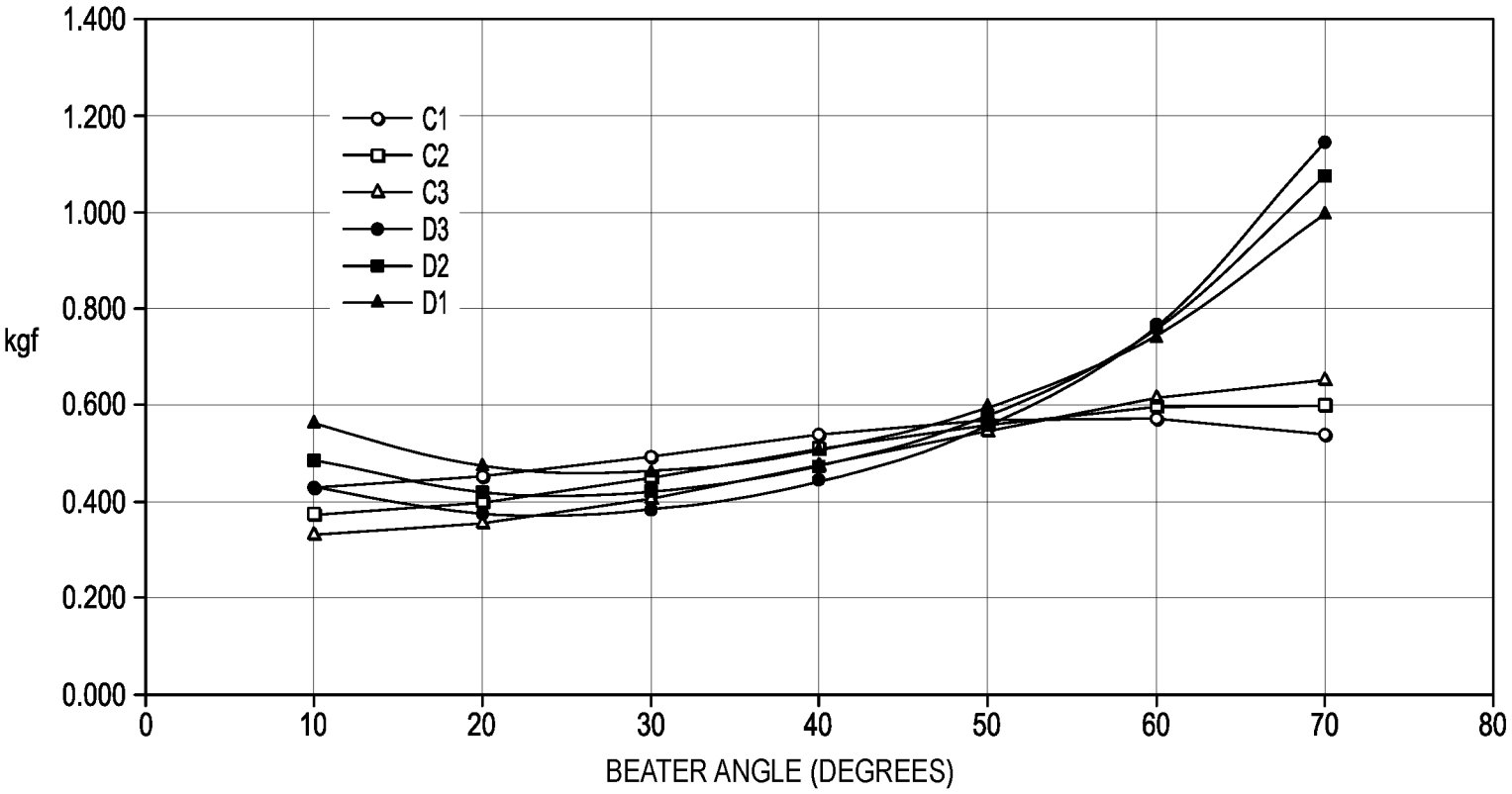
FIG. 12 is a graph obtained from Table 2, showing the relative footboard pedal force to move 10 degrees of the beater at respective positions C1-C3 and D1-D3.

Table 2 and FIG. 12, which is a graph obtained from the data in Table 2, show the relative footboard pedal force in kgf to move 10 degrees of the beater 6 (i.e., pivot the shaft 4 by 10 degrees) at respective positions C1-C3 and D1-D3. As illustrated in FIGS. 11-12, the positions C1-C3 exhibit substantial linear progression (pedal feel) between the beater travel angle of 10-40°. That is, at position C1, the pedal feel is heavier than at position C2 and C3 for the chain-drive transmission mechanism 8 since the terminal end 82*te* is closest to the pivot shaft 4. Between the beater travel angle of 40-70°, the footpedal feel becomes substantially constant for the chain-drive transmission mechanism 8. Overall, the chain transmission exhibits a substantial linear pedal feel throughout the beater travel at each of positions C1-C3.

The Tables 1-2 reveal that the direct-drive transmission mechanism exhibits a heavier pedal feel than the chain-drive transmission mechanism when comparing respective positions C1 to D1, C2 to D2, and C3 to D3. FIGS. 11-12 and Tables 1-2 illustrate differences in pedal feel between the two different transmission types, at respective corresponding positions C1-D1, C2-D2, and C3-D3. The chain-drive transmission mechanism 8 exhibits a more linear pedal feel in relation to the direct-drive transmission mechanism. The direct-drive transmission mechanism 80 exhibits a heavier pedal feel toward the impact point (during 50-70 degree of pivot shaft travel) than the chain-drive transmission, and exhibits progressively heavier pedal feel from 30-70 degrees.

Further, it should be appreciated that the present invention is not necessarily limited to the above-described embodiments and may be modified variously within the scope of the technical idea disclosed in the claims, specification and drawings.

For example, the connection of the transmission mechanism 8 or 80 to the connection member 20 are not limited to the screw and screw hole as set forth above and may be any conventionally-known engagement means as long as they can appropriately connect the transmission mechanism 8 or 80 to the connection member 20. Further, the coupling section 26 of the connection member 20 can have any other shape than illustrated in the drawings.

Further, the lower or second adjusting mechanism for adjusting the connected position between the connection member 20 and each of the transmission mechanisms 8 and 80 is not necessarily limited to the one where the screw hole 26*b* is formed as an elongated hole extending along the length of the pivoting-force transmitting path, and can be one where the screw hole 81*b* or 83*b* of each of the transmission mechanisms 8 and 80 rather than the screw hole 26*b* is formed as an elongated hole. As another example, the respective abutting surfaces of the coupling section 26 of the connection member 20 and the lower adjusting member/portion 81 or 83*a* of each of the transmission mechanisms 8 and 80 can be formed as fitting surfaces having mutually-engageable projections and recesses (concavities and convexities) and either the screw hole 26*b* of the connection member 20 or the screw hole 81*b* or 83*b* of each of the transmission mechanisms can be formed as an elongated hole extending along the length of the pivoting-force transmitting path so that the connected position between the connection member 20 and the transmission mechanism 8 or 80 can be determined and adjusted (adjustably determined) stepwise among a plurality of fitting positions on the fitting surface. As still another example, at least one of the connection member 20 or the transmission mechanism 8 or 80 can include a plurality of screw holes formed therein in a row extending in a connected-position adjusting direction (i.e., along the length of the pivoting-force transmitting path) so that the connected position between the connection member 20 and the transmission mechanism 8 or 80 is adjustable stepwise by engagement means, such as a screw, engaging any one of the screw holes.

Furthermore, the upper or first position adjusting mechanism for adjusting the connected position between each of the transmission mechanisms 8 and 80 and the pivot shaft 4 also can be modified variously similarly to the aforementioned various modifications of the position adjusting mechanism for adjusting the connected position between the connection member 20 and each of the transmission mechanisms 8 and 80.

Furthermore, whereas the foregoing have described the positioning mechanism where the connected position between the connection member 20 and the transmission mechanism 8 or 80 is adjustably determined by the projections 26*c* and the projections 81*c* or 83*c*, each having a saw tooth shape for example, that are complementary in shape, the positioning mechanism can be constructed in any other manner. For example, the positioning mechanism may comprise a combination of other forms of projections and recesses (convexities and concavities) having desired shapes and yet fittingly engageable with each other, as long as it permits engagement between the connection mechanism 20 and the transmission mechanism 8 or 80 selectively at any one of predetermined positions.

Furthermore, whereas the foregoing have described the positioning mechanism where the connected position between the transmission mechanism 8 or 80 and the rocker member 5 is adjustably determined by the projections 82*c* or 84*c*, each having a saw tooth shape for example, that are complementary in shape, the positioning mechanism can be constructed in any other manner. For example, the positioning mechanism can comprise a combination of other forms of projections and recesses (convexities and concavities) having desired shapes and yet fittingly engageable with each other, as long as it permits engagement between the transmission mechanism 8 or 80 and the rocker member 5 selectively at any one of predetermined positions.

Furthermore, the coupling section 26 employed in the present invention need not necessarily be a single coupling section capable of interchangeably connecting thereto different types of transmission mechanisms. Namely, in the present invention, separate coupling sections, differing in shape and construction from one another, can be employed for the individual types of transmission mechanisms, with each of the coupling sections having a shape and construction unique to any one of the types of transmission mechanisms.

Furthermore, the transmission mechanisms employed in the present invention are not limited to the chain-drive type and the direct-drive type and can be any other conventionally-known types, such as a belt-drive type that uses a belt formed of a rubber material, nylon material, leather material or the like.

This application is based on, and claims priority to, JP PA 2015-206379 filed on 20 Oct. 2015. The disclosure of the priority application, in its entirety, including the drawings, claims, and the specification thereof, are incorporated herein by reference.

What is claimed is:

1. A pedal apparatus for a percussion instrument comprising:

a striking mechanism including a rocker member mounted on a pivot shaft and configured to mount a beater for striking a striking surface of the percussion instrument in response to pivoting of the pivot shaft;

a footboard adapted for a depressing operation;

a connection member pivotably mounted to a distal end of the footboard;

a first transmission mechanism that transmits, to the pivot shaft, a pivoting motion responsive to depression of the footboard, and including:

a first transmission member;

a first position adjusting mechanism detachably and adjustably attached to the rocker member and that adjusts footboard depression characteristics, and including:

an upper adjusting member consisting essentially of an elongated rigid member that:

attaches to the rocker member from a proximal end side of the elongated rigid member so that a distal end side thereof extends outwardly to function as a lever that exclusively controls a pivoting-motion transmission path of the first transmission member;

is attached to an upper end of the first transmission member;

is movable relative to the rocker member to substantially linearly move an effective leveraging point between the first transmission member and the elongated rigid member at a resting position of the footboard to adjust the pivoting-motion transmission path of the first transmission member and adjust the footboard depression characteristics;

is lockable to any one of a first plurality of discrete positions relative to the rocker member; and exclusively controls the pivoting-motion transmission path of the first transmission member by disposing the effective leveraging point at a terminal distal end portion disposed at the distal end side of the elongated rigid member; and a second position adjusting mechanism detachably and adjustably attached to the connection member and pivotably attached to a lower end of the first transmission member and that adjusts an angle of the footboard at a resting position of the footboard.

2. The pedal apparatus for a percussion instrument according to claim 1, wherein:

changing the elongated rigid member to different positions among the first plurality of discrete positions changes the angle of the footboard at the footboard resting position, and the second position adjusting mechanism includes a lower adjusting member where a position thereof is adjustable relative to the connection member to compensate for the change in the angle of the footboard at the footboard resting position caused by the elongated rigid member changing to the different positions.

3. The pedal apparatus for a percussion instrument according to claim 1, wherein the first transmission mechanism is replaceable with a second transmission mechanism that includes a second transmission member of a different type.

4. The pedal apparatus for a percussion instrument according to claim 1, wherein:

the rocker member includes a first surface, the elongated rigid member includes a second surface that abuts the first surface, and the first and second surfaces are complementarily configured to position the elongated rigid member to be positioned to any one of the first plurality of discrete positions.

5. The pedal apparatus for a percussion instrument according to claim 4, wherein the first and second surfaces include complementary protrusions and recesses that allow the elongated rigid member to move stepwise along the rocker member among the first plurality of discrete positions.

6. The pedal apparatus for a percussion instrument according to claim 4, further including:

a pivot extending in a general horizontal direction;

wherein the connection member includes:

one end pivotably mounted to the distal end of the footboard via the pivot; and a coupling section that extends from the one end generally perpendicularly to the pivot.

7. The pedal apparatus for a percussion instrument according to claim 6, wherein:

the second position adjusting mechanism includes a lower adjusting member provided with a third surface, the coupling section includes a fourth surface that abuts with the third surface, and the third and fourth surfaces are complementarily configured to position the lower adjusting member to be positioned to any one of a second plurality of discrete positions.

8. The pedal apparatus for a percussion instrument according to claim 7, wherein the third and fourth surfaces include complementary protrusions and recesses that allow the lower adjusting member to move stepwise along the coupling section, among the second plurality of discrete positions, to adjust the footboard angle of the footboard at the resting position.

9. The pedal apparatus for a percussion instrument according to claim 1, wherein the first transmission member includes a flexible transmission member or a linkage.

10. The pedal apparatus for a percussion instrument according to claim 9, wherein:

the first transmission member is the flexible transmission member, and the flexible transmission member is attached to the proximal side of the elongated rigid member.

11. The pedal apparatus for a percussion instrument according to claim 9, wherein:

the first plurality of discrete positions include at least a first position and a second position, the first transmission member is the linkage, an upper end of the linkage is pivotably attached to the distal end side of the elongated rigid member via a pivot, and the terminal distal end portion is disposed at the pivot.

12. The pedal apparatus for a percussion instrument according to claim 11, wherein:

at the pivot is disposed closer to the rocker member at the first position than at the second position, at the footboard resting position and at each of the first plurality of discrete positions, the elongated rigid member and the linkage form an angle not greater than 90 degrees, and at a footboard fully depressed position, the elongated rigid member and the linkage form an angle not less than 180 degrees, while the pivot shaft pivots substantially about 70 degrees from the footboard resting position to the footboard fully depression position.

13. The pedal apparatus for a percussion instrument according to claim 9, wherein:

the transmission member is the flexible transmission member, the pivot shaft pivots substantially about 70 degrees between the footboard resting position and a footboard fully depressed position, and footboard depression force to pivot the pivot shaft substantially about 70 degrees is substantially linear for each of the plurality of positions.

14. The pedal apparatus for a percussion instrument according to claim 1, wherein:

the transmission member is a flexible transmission member;

the elongated rigid member includes a curved section provided with a curved supporting surface that contacts, at each of the first plurality of discrete positions and at the footboard resting position, at least one-half a length of the flexible transmission member.

* * * * *